US007688267B2

(12) United States Patent
Hill

(10) Patent No.: US 7,688,267 B2
(45) Date of Patent: Mar. 30, 2010

(54) BROADBAND ANTENNA WITH COUPLED FEED FOR HANDHELD ELECTRONIC DEVICES

(75) Inventor: Robert J. Hill, Salinas, CA (US)

(73) Assignee: Apple Inc., Cupertino, CA (US)

( * ) Notice: Subject to any disclaimer, the term of this patent is extended or adjusted under 35 U.S.C. 154(b) by 495 days.

(21) Appl. No.: 11/593,752

(22) Filed: Nov. 6, 2006

(65) Prior Publication Data

US 2008/0106478 A1 May 8, 2008

(51) Int. Cl.
*H01Q 1/24* (2006.01)

(52) U.S. Cl. ..... 343/702

(58) Field of Classification Search ..... 343/700 MS, 343/702, 725, 815–817, 846
See application file for complete search history.

(56) References Cited

U.S. PATENT DOCUMENTS

| | | | | |
|---|---|---|---|---|
| 4,876,552 | A | 10/1989 | Zakman | |
| 4,903,326 | A | 2/1990 | Zakman et al. | |
| 5,274,391 | A | 12/1993 | Connolly | |
| 6,281,850 | B1 | 8/2001 | Klostermann et al. | |
| 6,292,153 | B1 | 9/2001 | Aiello et al. | |
| 6,486,836 | B1 | 11/2002 | Hill | |
| 6,603,430 | B1 | 8/2003 | Hill et al. | |
| 6,903,692 | B2 * | 6/2005 | Kivekas et al. | 343/702 |
| 6,982,675 | B2 * | 1/2006 | Kwak et al. | 343/702 |
| 7,352,326 | B2 * | 4/2008 | Korva et al. | 343/700 MS |
| 2002/0019247 | A1 * | 2/2002 | Egorov | 455/557 |
| 2004/0008146 | A1 | 1/2004 | Ikegaya et al. | |
| 2004/0017318 | A1 | 1/2004 | Annabi et al. | |
| 2004/0108957 | A1 | 6/2004 | Umehara et al. | |
| 2004/0212545 | A1 | 10/2004 | Li et al. | |
| 2004/0257283 | A1 | 12/2004 | Asano et al. | |
| 2005/0093750 | A1 * | 5/2005 | Vance | 343/702 |
| 2005/0128151 | A1 * | 6/2005 | Kwak et al. | 343/702 |
| 2006/0038721 | A1 * | 2/2006 | Ozkar et al. | 343/700 MS |
| 2006/0208950 | A1 | 9/2006 | Tago | |
| 2007/0182658 | A1 * | 8/2007 | Ozden | 343/866 |
| 2008/0231521 | A1 | 9/2008 | Anguera Pros et al. | |

FOREIGN PATENT DOCUMENTS

| | | | |
|---|---|---|---|
| EP | 1 351 334 | A | 10/2003 |
| EP | 1 401 050 | A | 3/2004 |
| FR | 2 821 985 | | 9/2002 |
| WO | 2004/001894 | A | 12/2003 |
| WO | 2005/109567 | A | 11/2005 |
| WO | 2006/070017 | | 7/2006 |

* cited by examiner

*Primary Examiner*—Huedung Mancuso
(74) *Attorney, Agent, or Firm*—Treyz Law Group; G. Victor Treyz; Nancy Y. Ru

(57) ABSTRACT

Broadband antennas and handheld electronic devices with broadband antennas are provided. A handheld electronic device may have a housing in which electrical components such as integrated circuits and a broadband antenna are mounted. The broadband antenna may have a ground element and a resonating element. The resonating element may have two arms of unequal length and may have a self-resonant element. The antenna may have a feed terminal connected to the self-resonant element and a ground terminal connected to the ground element. The self-resonant element may be near-field coupled to one of the arms of the resonating element. With one suitable arrangement, the self-resonant element may be formed using a conductive rectangular element that is not electrically shorted to the ground element or the arms of the resonating element. The antenna may operate over first and second frequency ranges of interest.

27 Claims, 16 Drawing Sheets

BROADBAND ANTENNA WITH COUPLED FEED FOR HANDHELD ELECTRONIC DEVICES

BACKGROUND

This invention relates generally to antennas, and more particularly, to broadband antennas in wireless handheld electronic devices.

Handheld electronic devices are often provided with wireless capabilities. Handheld electronic devices with wireless capabilities use antennas to transmit and receive radio-frequency signals. For example, cellular telephones contain antennas that are used to handle radio-frequency communications with cellular base stations. Handheld computers often contain short-range antennas for handling wireless connections with wireless access points. Global positioning system (GPS) devices typically contain antennas that are designed to operate at GPS frequencies.

As technology advances, it is becoming possible to combine multiple functions into a single device and to expand the number of communications bands a single device can handle. For example, it is possible to incorporate a short-range wireless capability into a cellular telephone. It is also possible to design cellular telephones that cover multiple cellular telephone bands.

The desire to cover a wide range of radio frequencies presents challenges to antenna designers. It is typically difficult to design antennas that cover a wide range of communications bands while exhibiting superior radio-frequency performance. This is particularly true when designing antennas for handheld electronic devices where antenna size and shape can be particularly important.

As a result of these challenges, conventional handheld devices that need to cover a large number of communications bands tend to use multiple antennas, antennas that are undesirably large, antennas that have awkward shapes, or antennas that exhibit poor efficiency.

It would therefore be desirable to be able to provide an improved broadband antenna for a handheld electronic device.

SUMMARY

In accordance with the present invention, broadband antennas and handheld electronic devices with broadband antennas are provided. A handheld electronic device with a broadband antenna may be cellular telephone with integrated music player capabilities, a personal digital assistant, or any other suitable handheld electronic device. The handheld device may include components such as integrated circuits. The integrated circuits may be encased in conductive materials, such as metal radio-frequency shielding.

A broadband antenna may include a resonating element and a ground element. The resonating element may have two conductive arms and a self-resonant element. An antenna feed terminal may be connected to the self-resonant element and an antenna ground terminal may be connected to the ground element. The self-resonant element may be electromagnetically coupled to at least one of the two conductive arms in the resonating element through near-field interactions. The self-resonant element may be separated from the rest of the resonating element by dielectric gaps. With one suitable arrangement, the self-resonant element is not electrically shorted to the ground element or the two conductive arms. If desired, the self-resonant element may be parallel fed by connecting one end of the self-resonant element to the ground element with a strip of conductor.

The ground element may be formed at least partly from the radio-frequency shielding or other conductive portion that surrounds the integrated circuits. If desired, the resonating element may be formed on a flex circuit or other suitable flexible or rigid substrate. The flex circuit may be mounted on or within a support structure and may be mechanically and electrically attached to a grounded circuit board.

The broadband antenna and other components in the handheld electronic device may be mounted within a housing. The housing may be formed from dielectric materials, conductive materials, or a combination of dielectric and conductive materials. With one suitable arrangement, the housing is formed partially from metal and has a plastic cap in the vicinity of the resonating element.

Further features of the invention, its nature and various advantages will be more apparent from the accompanying drawings and the following detailed description of the preferred embodiments.

DETAILED DESCRIPTION

Figure 1:
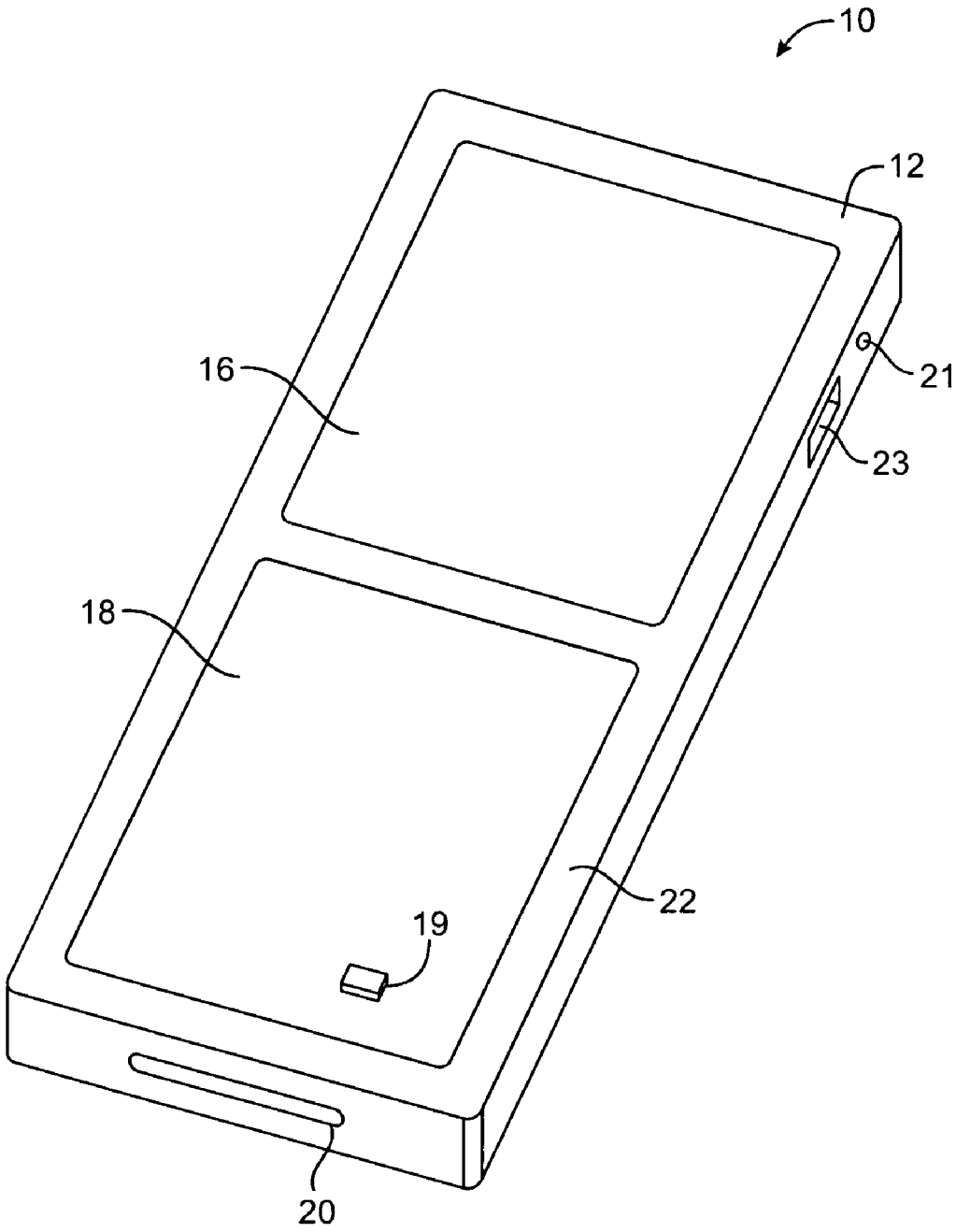
FIG. 1 is a perspective view of an illustrative handheld electronic device with a broadband antenna in accordance with an embodiment of the present invention.

An illustrative portable electronic device in accordance with the present invention is shown in FIG. 1. Portable electronic devices such as illustrative portable electronic device 10 may be small portable computers such as those sometimes referred to as ultraportables. Portable devices may also be somewhat smaller devices. Examples of smaller portable devices include wrist-watch devices, pendant devices, headphone and earpiece devices, and other wearable and miniature devices. With one particularly suitable arrangement, the portable electronic devices are handheld electronic devices. The use of handheld devices is generally described herein as an example, although any suitable electronic device may be used if desired.

Handheld devices may be, for example, cellular telephones, media players with wireless communications capabilities, handheld computers (also sometimes called personal digital assistants), remote controllers, global positioning system (GPS) devices, and handheld gaming devices. The handheld devices of the invention may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples. Device 10 may be any suitable portable or handheld electronic device.

Device 10 includes housing 12 and includes at least one antenna of a type that is sometime referred to as a broadband antenna. Housing 12, which is sometimes referred to as a case, may be formed of any suitable materials including, plastic, wood, glass, ceramics, metal, or other suitable materials, or a combination of these materials. In some situations, all or part of case 12 may be formed from dielectric or other low-conductivity material, so that the operation of conductive antenna elements that are located in proximity to case 12 is not disrupted. In other situations, case 12 may be formed from metal elements that serve as ground for the broadband antenna.

The broadband antenna in device 10 has a resonating element (sometimes referred to as a radiating element or a positive element) and has a ground element (sometimes referred to as a negative element or ground). The ground and the resonating element of the antenna are coupled to a corresponding ground terminal and feed terminal associated with a radio-frequency transceiver in handheld device 10.

Handheld electronic device 10 may have input-output devices such as a display screen 16, buttons such as button 23, user input control devices 18 such as button 19, and input-output components such as port 20 and input-output jack 21. Display screen 16 may be, for example, a liquid crystal display (LCD), an organic light-emitting diode (OLED) display, a plasma display, or multiple displays that use one or more different display technologies. As shown in the example of FIG. 1, display screens such as display screen 16 can be mounted on front face 22 of handheld electronic device 10. Front face 22 and the rear face of device 10 may be planar. If desired, displays such as display 16 can be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface 18. User input interface 18 may include buttons (e.g., alphanumeric keys, power on-off, power-on, power-off, and other specialized buttons, etc.), a touch pad, pointing stick, or other cursor control device, a touch screen (e.g., a touch screen implemented as part of screen 16), or any other suitable interface for controlling device 10. Although shown schematically as being formed on the top face 22 of handheld electronic device 10 in the example of FIG. 1, user input interface 18 may generally be formed on any suitable portion of handheld electronic device 10. For example, a button such as button 23 (which may be considered to be part of input interface 18) or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as bus connector 20 and jack 21 that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device can be controlled using input interface 18.

Components, such as display 16 and user input interface 18, may cover most of the available surface area on the front face 22 of device 10 (as shown in the example of FIG. 1) or may occupy only a small portion of the front face 22. Because electronic components such as display 16 often contain large amounts of metal (e.g., metal used as radio-frequency shielding), the location of these components relative to the antenna elements in device 10 should generally be taken into consideration. Suitably chosen locations for the antenna elements and electronic components of the device will allow the antenna of handheld electronic device 10 to function properly without being disrupted by the electronic components.

Figure 2:
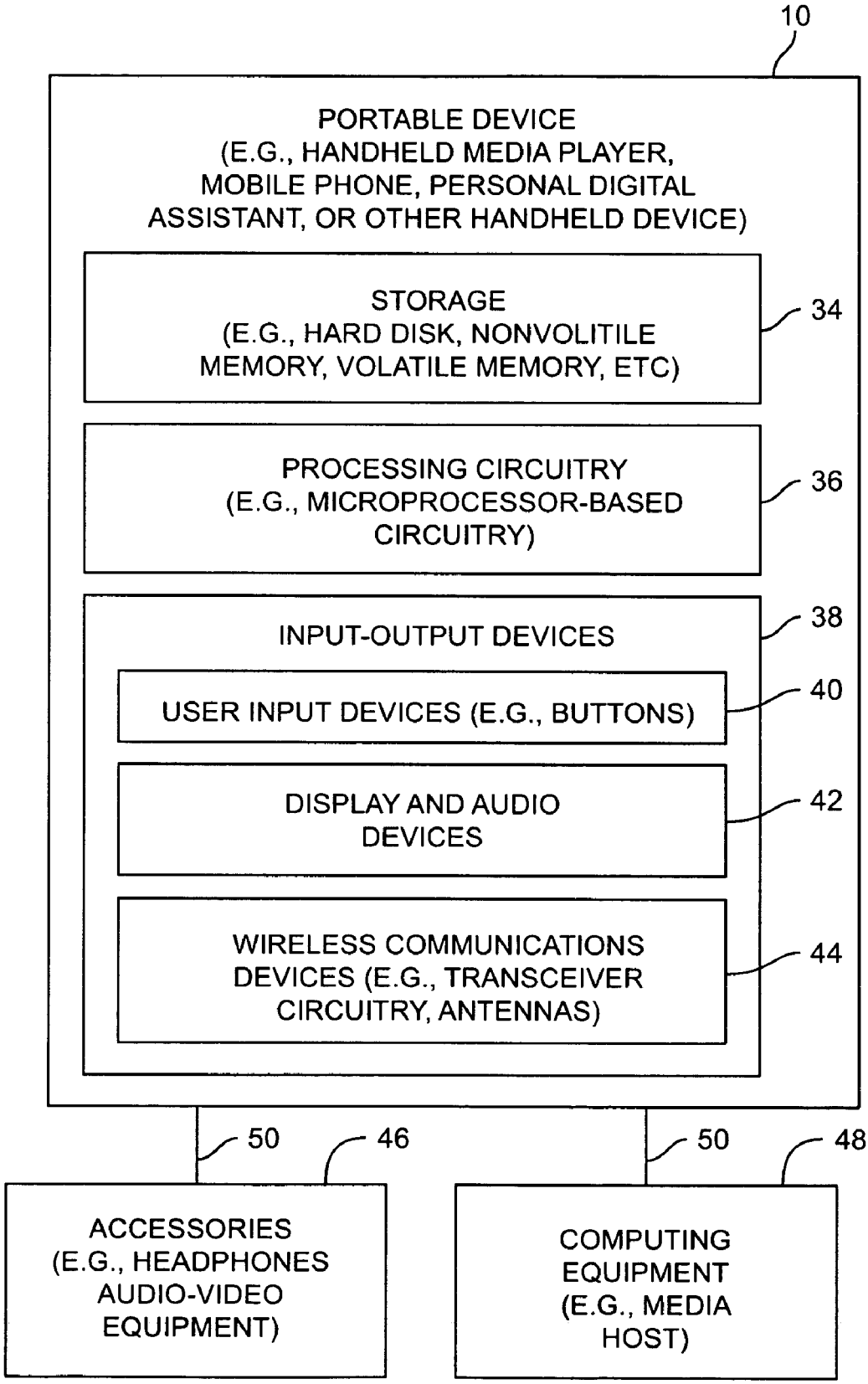
FIG. 2 is a schematic diagram of an illustrative handheld electronic device and illustrative equipment with which the handheld electronic device may interact wirelessly in accordance with an embodiment of the present invention.

A schematic diagram of an illustrative handheld electronic device of the type that may contain a broadband antenna is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits.

Input-output devices 38 may be used to allow data to be supplied to device 10 and to allow data to be provided from device 10 to external devices. Display screen 16 and user input interface 18 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, antennas, such as a broadband antenna of the type described in connection with FIG. 1, and, if desired, additional antennas, and other circuitry for handling RF wireless signals. Wireless signals can also be sent using light (e.g., using infrared communications).

Device 10 can communicate with external devices, such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content). Computing equipment 48 may be a server from which songs, videos, or other media are downloaded over a cellular telephone link or other wireless link. Computing equipment 48 may also be a local host (e.g., a user's own personal computer), from which the user obtains a wireless download of music or other media files.

Wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) band at 2.4 GHz, and the Bluetooth® band at 2.4 GHz. These are merely illustrative communications bands over which wireless devices 44 may operate. Additional bands are expected to be deployed in the future as new wireless services are made available. Wireless devices 44 may be configured to operate over any suitable band or bands to cover any existing or new services of interest. If desired, multiple antennas may be provided in wireless devices 44 to cover more bands or one or more antennas may be provided with wide-bandwidth resonating elements to cover multiple communications bands of interest. An advantage of using a broadband antenna design that covers multiple communications bands of interest is that this type of approach makes it possible to reduce device complexity and cost and to minimize the amount of a handheld device that is allocated towards antenna structures.

A broadband design may be used for one or more antennas in wireless devices 44 when it is desired to cover a relatively larger range of frequencies without providing numerous individual antennas or using a tunable antenna arrangement. If desired, a broadband antenna design may be made tunable to expand its bandwidth coverage or may be used in combination with additional antennas. In general, however, broadband designs tend to reduce or eliminate the need for multiple antennas and tunable configurations.

Figure 3:
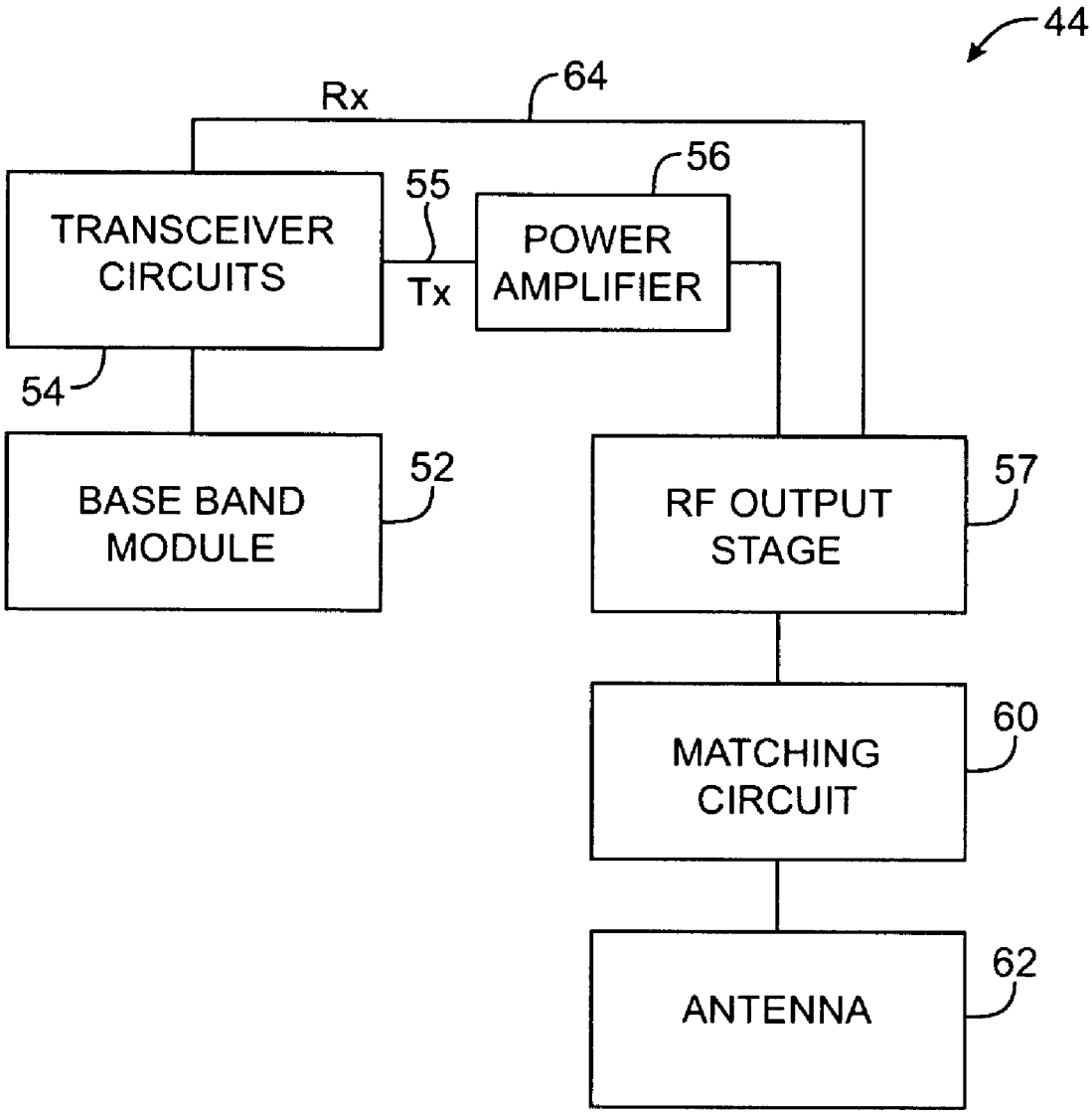
FIG. 3 is a schematic diagram of illustrative wireless circuitry for a handheld electronic device in accordance with an embodiment of the present invention.

Illustrative wireless communications devices 44 that are based on a broadband antenna arrangement are shown in FIG. 3. As shown in FIG. 3, wireless communications devices 44 include at least one broadband antenna 62. Data signals that are to be transmitted by device 10 may be provided to baseband module 52 (e.g., from processing circuitry 36 of FIG. 2). Baseband module 52 may provide data to be transmitted to transmitter circuitry within transceiver circuits 54. The transmitter circuitry may be coupled to power amplifier circuitry 56 via path 55.

During data transmission, power amplifier circuitry 56 may boost the output power of transmitted signals to a sufficiently high level to ensure adequate signal transmission. Radio-frequency (RF) output stage 57 may contain radio-frequency switches and passive elements such as duplexers and diplexers. The switches in the RF output stage 57 may, if desired, be used to switch devices 44 between a transmitting mode and a receiving mode. Duplexer and diplexer circuits and other passive components in RF output stage may be used to route input and output signals based on their frequency.

Matching circuit 60 may include a network of passive components such as resistors, inductors, and capacitors and ensures that broadband antenna 62 is impedance matched to the rest of the circuitry 44. Wireless signals that are received by antenna 62 are passed to receiver circuitry in transceiver circuitry 54 over a path such as path 64.

Figure 4:
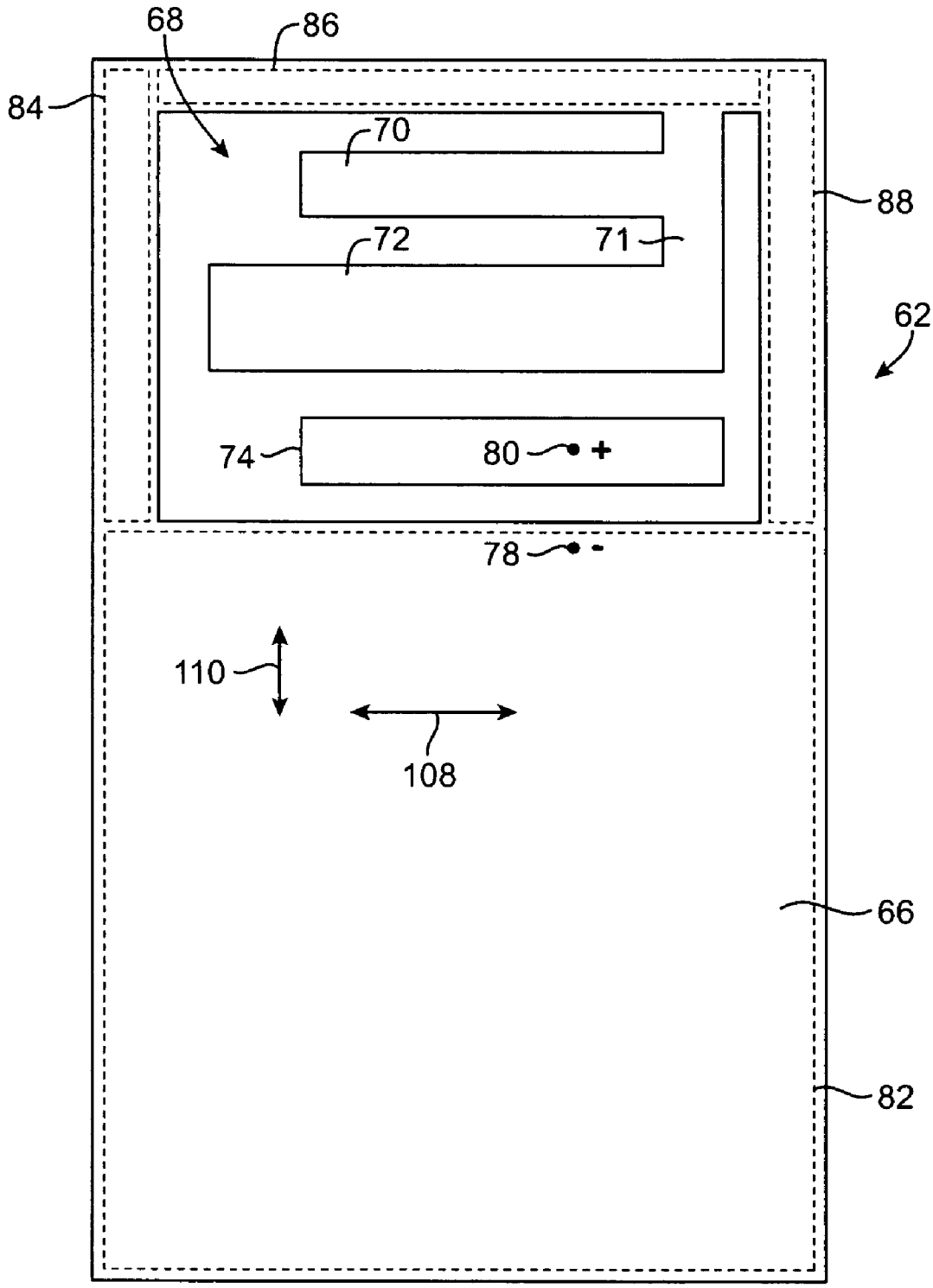
FIG. 4 is a plan view of an illustrative broadband antenna in accordance with an embodiment of the present invention.

An illustrative arrangement that may be used for broadband antenna 62 is shown in FIG. 4. As shown in FIG. 4, antenna 62 may include ground element 66 and resonating element 68. Signals may be conveyed between electrical components in device 10 and antenna 62 using a coaxial cable or other suitable radio-frequency (RF) signal path. With one illustrative arrangement, a coaxial cable center conductor can be connected to antenna feed terminal connection point 80 and a coaxial cable outer conductor can be connected to antenna ground terminal connection point 78. This is merely illustrative. In general, signals may be provided to antenna 62 and may be received from antenna 62 using any suitable antenna terminal arrangement.

Resonating element 68 of FIG. 4 can have two arms 70 and 72 of unequal length and a self-resonant antenna element 74. Arms 70 and 72 can form an "F" shape and may sometimes be referred to collectively as a F-shaped resonating element or an F-shaped antenna element. Feed terminal 80 can be connected to self-resonant antenna element 74, so antenna element 74 (and more generally resonating element 68) may sometimes be referred to as an antenna feed element or feed.

As shown in the example of FIG. 4, ground 66 can have a rectangular ground plane portion, as indicated by rectangular dotted-line box 82. Additional ground portions can extend the ground around the periphery of the resonating element and surround three sides of the resonating element. The additional ground portions can include two side ground extension portions and a top ground extension portion. The locations of the side ground extension portions are indicated by dotted-line boxes 84 and 88. The location of the top ground extension portion is indicated by dotted-line box 86. In the example of FIG. 4, ground portions 82, 84, 86, and 88 of ground 66 surround all four sides of resonating element 68. This creates an overall substantially rectangular shape for antenna 62 that has ground portions on all four of its edges. An advantage of this type of grounding arrangement is that it reduces, or even avoids, undesirable antenna-housing interactions that might otherwise arise when antenna 62 is installed in conductive housings 12 (e.g., a grounded metal housing).

Figure 5:
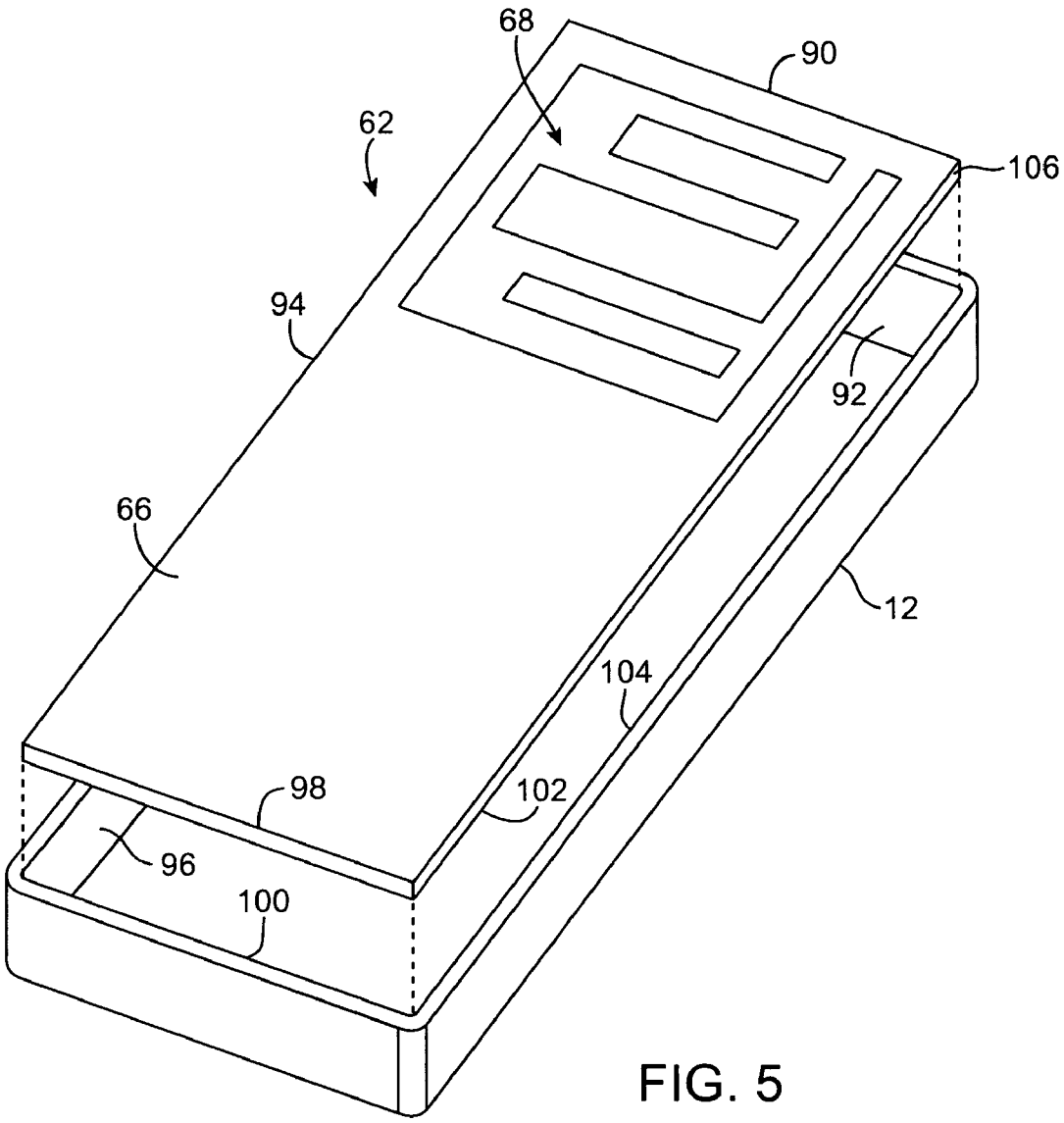
FIG. 5 is a perspective view of an illustrative broadband antenna in accordance with an embodiment of the present invention.

As shown in FIG. 5, when antenna 62 is installed in housing 12, antenna edge 90 can be adjacent to housing side 92, antenna edge 94 can be adjacent to housing side 96, antenna edge 98 can be adjacent to housing side 100, and antenna edge 102 can be adjacent to housing side 104. If sides 92, 96, 100, and 104 are conductive, it may be desirable to use a grounding arrangement for antenna 62 in which portions of ground 66 surround the periphery of the antenna 62 as described in connection with FIG. 4, thereby avoiding undesirable conditions in which portions of the resonating element directly abut the housing. The arrangement of FIGS. 4 and 5 is, however, merely illustrative. Any suitable grounding arrangement may be used for antenna 62 if desired.

Illustrative antenna 62 of FIGS. 4 and 5 uses a planar form factor. This is merely illustrative. Antenna 62 may, if desired, be formed using three-dimensional antenna structures, such as structures in which ground 66 is located in a different plane than resonating element 68. When a three-dimensional antenna structure is used, device 10 can sometimes be configured to house a greater number of electronic components. When more electronic components are included in device 10, device 10 can provide more functionality to a user.

In the example of FIG. 5, antenna 62 can be formed from patterned conductor attached to a mounting structure 106. The patterned conductor can be formed on the top of mounting structure 106 or on both sides of mounting structure 106 (e.g., using an arrangement in which a mirror image of the top-side patterned conductor is formed on the bottom side of the mounting structure). If a double-sided arrangement is desired, conductive vias may be used to electrically connect the conductors on the top and bottom surfaces of mounting structure 106.

Mounting structure 106 may be any suitable mounting structure for proving physical support for elements 66 and 68. Suitable mounting structures include mounting structures formed from circuit board materials, ceramics, glass, plastic, or other dielectrics. The mounting structure 70 may, if desired, be formed from part of housing 12 (FIG. 1). Antenna components such as ground 66 may also be formed using conductive elements in device 10, such as conductive radio-frequency conductive shielding that surrounds electronic components in device 10. When such components are used to form ground 66, a mounting structure such as mounting structure 106 can be used to provide physical support for resonating element 66.

Suitable circuit board materials for mounting structure 106 include, for example, paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Mounting structure 106 may be formed from a combination of any number of these materials or other suitable materials. Mounting structure 106 may be flexible or rigid or may have both flexible and rigid portions. Ground 66 and resonating element 68 may be formed from any suitable conductors such as silver, gold, copper, brass, other metals, or other conductive materials. These are merely illustrative examples. In general, antenna components, such as resonating element 68 and ground element 66, may be formed using any suitable conductive antenna materials and mounting structures.

Ground element 66 and resonating element 68 may be mounted so that they lie in substantially the same plane, as shown in FIGS. 4 and 5. In three-dimensional antenna arrangements, some or all of ground 66 may also be extended into other planes. In the two-dimensional example of FIGS. 4 and 5, ground element 66 and resonating element 68 can lie in a common plane that contains the surface of mounting structure 106, as shown in FIG. 5.

The dimensions of the components of antenna 62 may be selected based on the desired frequency ranges of operation for antenna 62. Self-resonant element 74 has peak efficiency at the frequency at which its length corresponds to about a quarter of a wavelength. The size of ground element 66 may be selected so as to provide sufficient space in device 10 for mounting electronic components.

As shown in FIG. 4, the lengths of the antenna elements may be measured along a dimension parallel to axis 108, while the heights of the antenna elements may be measured along a dimension parallel to axis 110. In one illustrative arrangement, arm 70 has a height of about 5 mm and a length of about 4 cm, arm 72 has a height of about 1 cm and a length of about 5 cm, self-resonant element 74 has a height of about 4 mm and a length of about 4.5 cm. The gaps between the long edges of the conductive portions of resonating element 68 may be about 1-3 mm (e.g., at least 1 mm, at least 2 mm, at least 3 mm, etc.). These gaps are made up of air, circuit board material, or other suitable dielectric materials.

Although a range of possible dimensions may be used for arm 70, arm 72, and self-resonant element 74, the constraints imposed by convenient sizes for handheld device 10 and the desired frequency bands for antenna operation generally lead to the lengths of these antenna components being less than 10 cm and the heights of these antenna elements being between about 3 mm and 10 mm.

Figure 6:
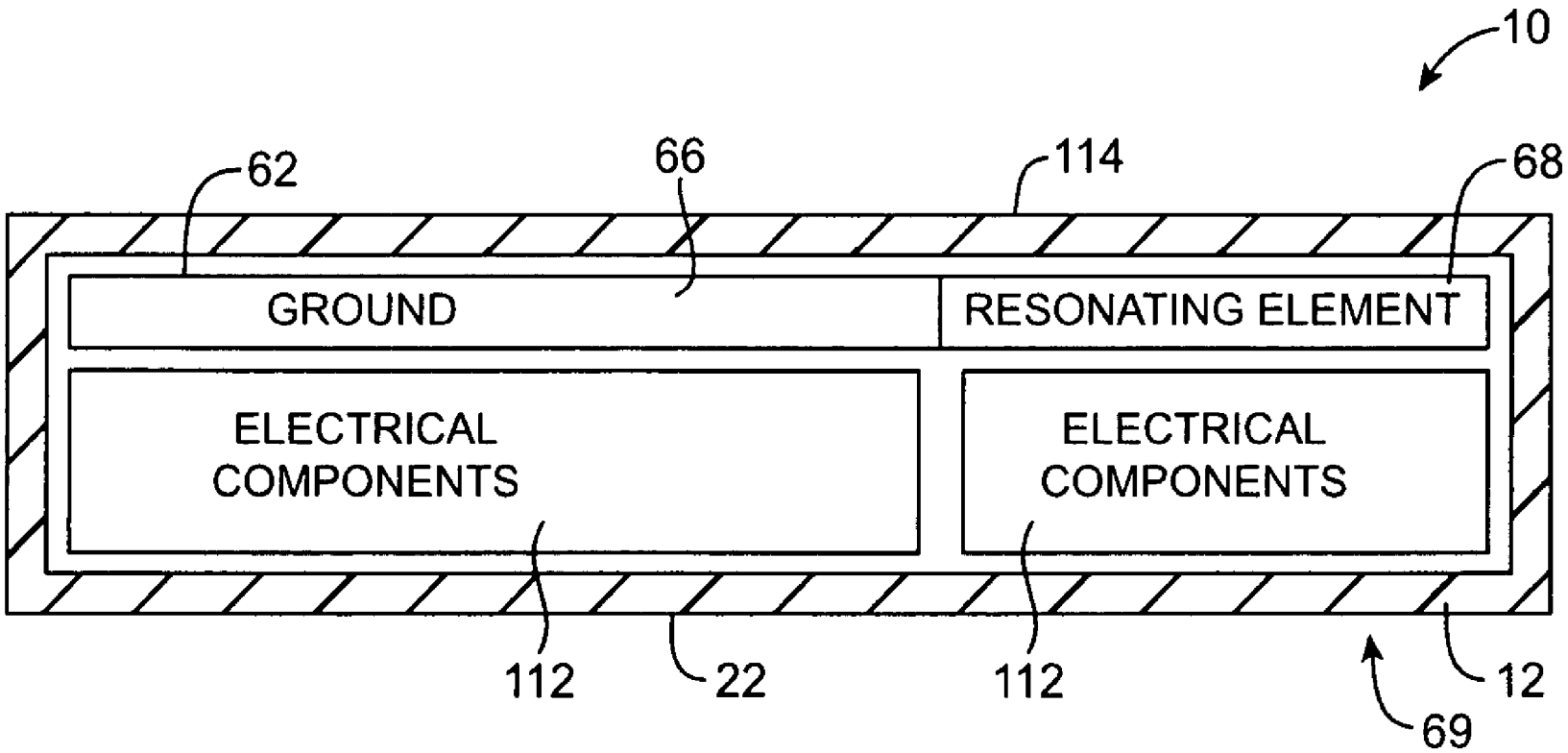
FIG. 6 is a cross-sectional side view of an illustrative handheld electronic device containing electronic components and an illustrative broadband antenna in accordance with an embodiment of the present invention.

It is generally desirable to avoid locating large amounts of grounded conductor too close to resonating element 68. This consideration affects the layout used for device 10. A cross-sectional view of an illustrative arrangement that may be used for device 10 without disturbing the proper operation of device 10 is shown in FIG. 6. In the example of FIG. 6, electrical components 112 can be located near front face 22 of device 10 and antenna 62 can be located near back face 114 of device 10. Electrical components 112 typically include components, such as speakers, cameras, microphones, batteries, integrated circuits, keypads and other user control interfaces, connectors such as input-output jacks and power jacks, status indicators such as light-emitting diodes, displays such as liquid crystal displays, etc.

To avoid radio-frequency interference, some or all of components 112 may be surrounded with radio-frequency shielding. For example, integrated circuits in device 10 may be surrounded by copper ground conductors. Other components may contain large conductive portions (e.g., for grounding). Components 112 with radio-frequency shielding conductor or other large amounts of conductor are preferably mounted away from resonating element 68 (e.g., adjacent to ground 66), so as not to interfere with proper operation of antenna 62. Components 112 with less conductive material or which need to be at end 69 of device 10 for proper operation (e.g., a microphone) can be located in the vicinity of resonating element 68. If desired, the region under resonating element 68 (in the orientation of FIG. 6) may be left empty. With this type of arrangement, air fills the region under resonating element 68.

Antenna 62 may provide coverage over at least two frequency ranges of interest. The two frequency ranges may be non-overlapping. With one suitable arrangement, antenna 62 operates over a first frequency range of interest that covers cellular telephone bands such as the 850 MHz and 900 MHz bands and operates over a second frequency range of interest that covers cellular telephone bands such as the 1800 MHz and 1900 MHz bands, and data bands including the 2170 MHz data band (used for 3G data services) and the 2.4 GHz data band (used for WiFi and Bluetooth). These are merely examples of suitable frequency ranges in which antenna 62 may operate. Antenna 62 may operate in other suitable frequency ranges if desired (e.g., by modifying the sizes and relative spacing of the antenna elements in antenna 62).

The way in which the components of antenna 62 work with each other to provide satisfactory operation over the first and second frequency ranges is described in connection with FIGS. 7-19.

Figure 7:
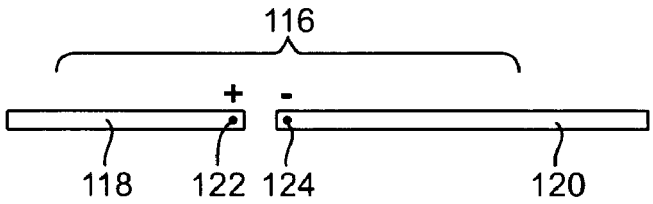
FIG. 7 is a diagram of an illustrative asymmetrical dipole antenna in accordance with an embodiment of the present invention.

FIG. 7 shows an asymmetric dipole antenna 116. Antenna 116 can have ground element 120 and resonating element 118. Antenna 116 can have feed terminal 122 and ground terminal 124.

Figure 8:
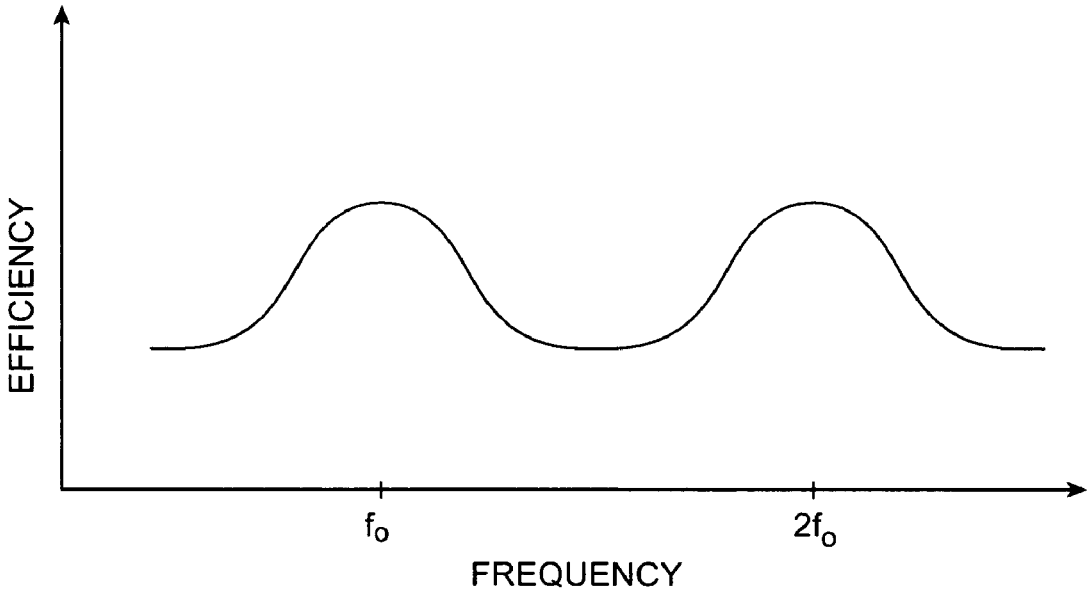
FIG. 8 is a diagram of an illustrative efficiency versus frequency characteristic for an asymmetrical dipole antenna of the type shown in FIG. 7 in accordance with an embodiment of the present invention.

Asymmetric dipole antennas of the type shown in FIG. 7 exhibit efficiency versus frequency characteristics of the type shown in FIG. 8. As shown in FIG. 8, antenna 116 can operate satisfactorily in two frequency ranges—a first frequency range centered about a frequency $f_0$ and a second frequency range centered about a frequency $2f_0$.

Figure 9:
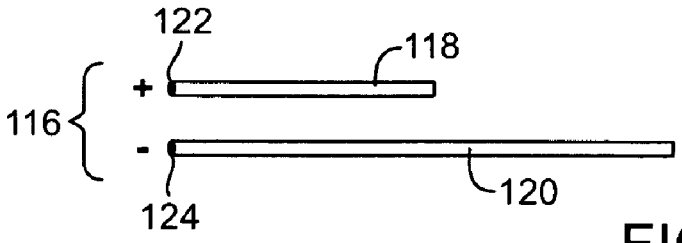
FIG. 9 is a diagram of an illustrative asymmetric dipole antenna having parallel antenna elements in accordance with an embodiment of the present invention.

As shown in FIG. 9, antenna 116 can continue to function, even if the resonating element 118 and ground element 120 are arranged to be parallel to each other. In the arrangement of FIG. 9, terminals 122 and 124 can provide signals to the ends of elements 118 and 120. This type of arrangement is therefore sometimes referred to as an "end fed" antenna. Because elements 118 and 120 are not shorted together, this type of arrangement is also sometimes referred to as a "series fed" antenna.

Figure 10:
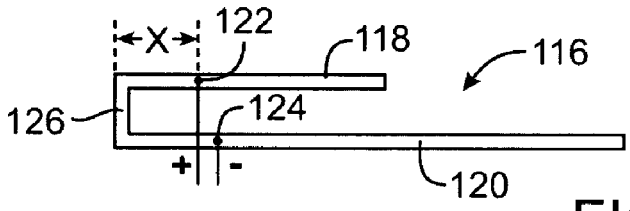
FIG. 10 is a diagram of an illustrative parallel-fed asymmetric dipole antenna in accordance with an embodiment of the present invention.

In practice, it can be difficult to construct satisfactory antennas using a series-fed end-fed architecture. As a result, antennas sometimes use a parallel feed architecture of the type shown in FIG. 10. The antenna 116 of FIG. 10 is shorted with shorting conductor 126 at the ends of elements 118 and 120 and is parallel fed through terminals 122 and 124 that are located a distance X from the antenna's shorted end. Use of the parallel-fed end-fed antenna arrangement of FIG. 10 can allow an antenna designer to more easily satisfy antenna design criteria. For example, an antenna designer can match the antenna's impedance to the impedance of the coaxial cable or other radio-frequency (RF) signal path that is used to connect the antenna to an associated transceiver by appropriate selection of the distance X. Parallel-fed end-fed antennas are also more tolerant of large mismatches between the lengths of elements 118 and 120 than series-fed end-fed antennas, which provides an antenna designer with greater leeway when designing an antenna to cover certain desired frequency ranges. Conventional cellular telephones are sometimes constructed using an arrangement of the type shown in FIG. 10 in which elements 118 and 120 form conductive sheets that extend along a dimension that is into the page in the orientation of FIG. 10.

Figure 11:
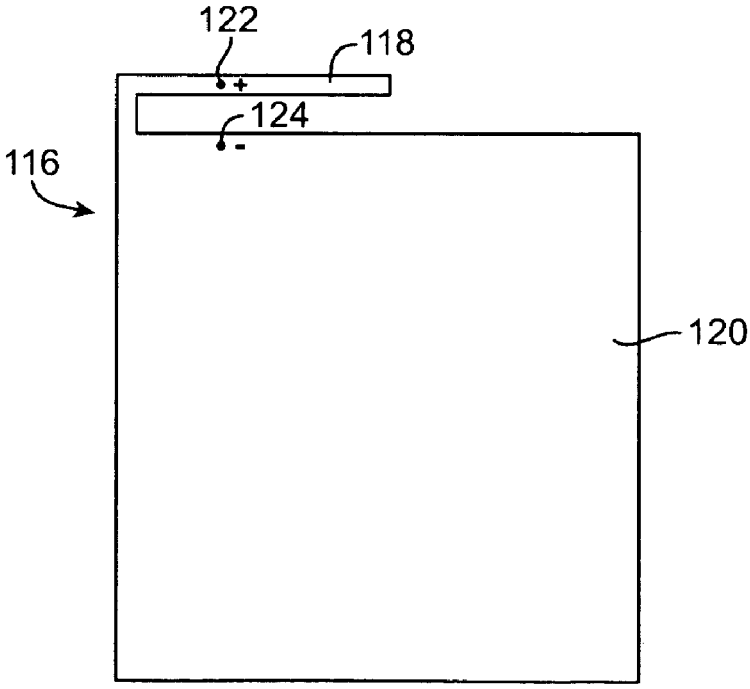
FIG. 11 is a diagram of an illustrative asymmetric dipole antenna having a larger ground plane.

As shown in FIG. 11, the size of ground element 120 in antenna 116 can be enlarged to form a rectangle while the size of resonating element 118 is maintained the same. The theory of operation for antenna 116 of FIG. 11 is basically the same as antenna 116 in FIG. 10.

Figure 12:
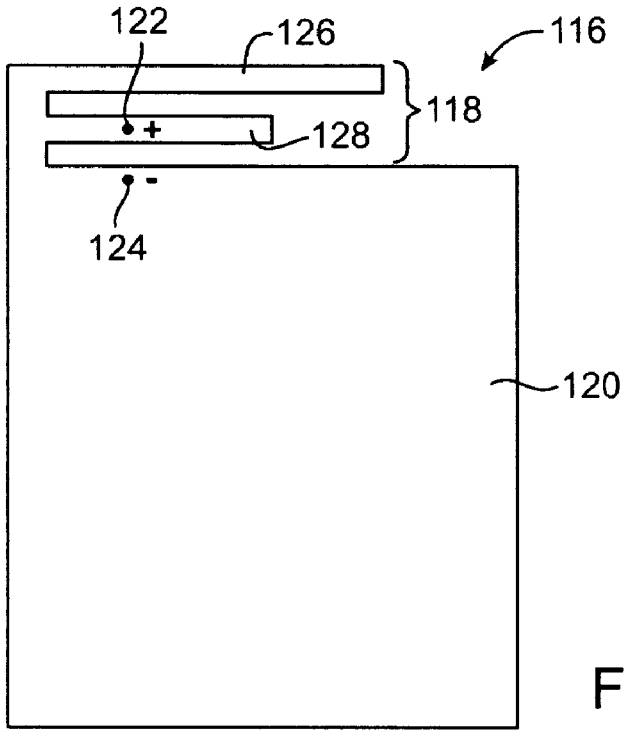
FIG. 12 is a diagram of an illustrative asymmetric dipole antenna having two resonating element arms of unequal length in accordance with an embodiment of the present invention.

FIG. 12 shows an arrangement in which resonating element 118 of antenna 116 has been provided with two arms 126 and 128. Because there are two "lengths" associated with the resonating element 118, antenna 116 of FIG. 12 can cover a wider frequency range than antenna 116 of the type shown in FIG. 11. Arm 126 can cause antenna 116 to resonate in first and second frequency ranges centered about $f_0$ and $2f_0$, respectively. Arm 128 causes antenna 116 to resonate in first and second frequency ranges centered about $f_0'$ and $2f_0'$, respectively. Because both arm 126 and arm 128 contribute to the performance of antenna 116, in practice, antenna 116 can exhibit a frequency response that is a superposition of the response contributed by arm 126 and the response contributed by arm 128. The first frequency range covered by antenna 116 therefore encompasses both the range centered about $f_0$ and the range centered about $f_0'$. Similarly, the second frequency range of operation can cover the ranges centered about $2f_0$ and $2f_0'$.

In antenna 116 of FIG. 12, resonating element 118 is not surrounded by ground 120. This type of arrangement may be satisfactory in some mounting arrangements (e.g., those in which the walls of a device housing are not formed from grounded metal or other such conductive structures).

Figure 13:
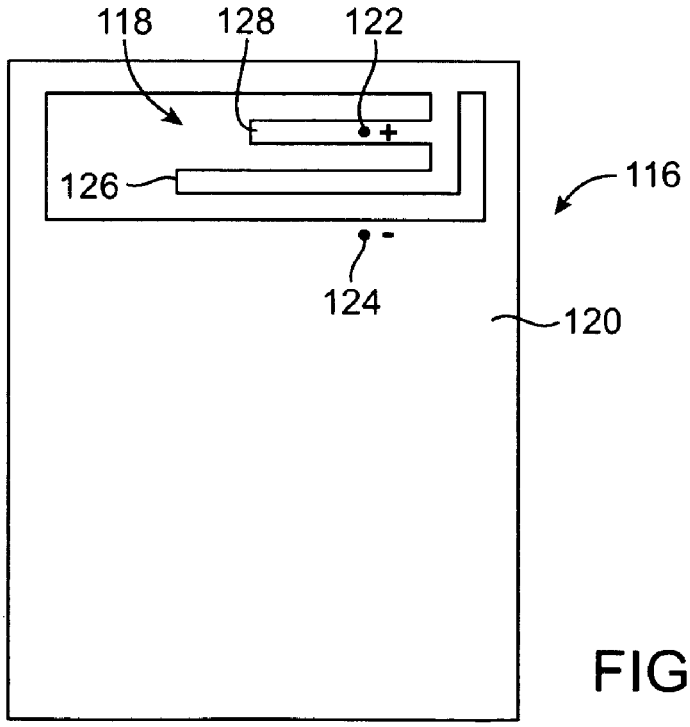
FIG. 13 is a diagram of another illustrative asymmetric dipole antenna having two resonating element arms of unequal length in accordance with an embodiment of the present invention.

In the arrangement of FIG. 13, resonating element 118 is surrounded by ground 120, which makes antenna 116 suitable for installation in devices that have grounded side walls that abut the antenna.

Figure 14:
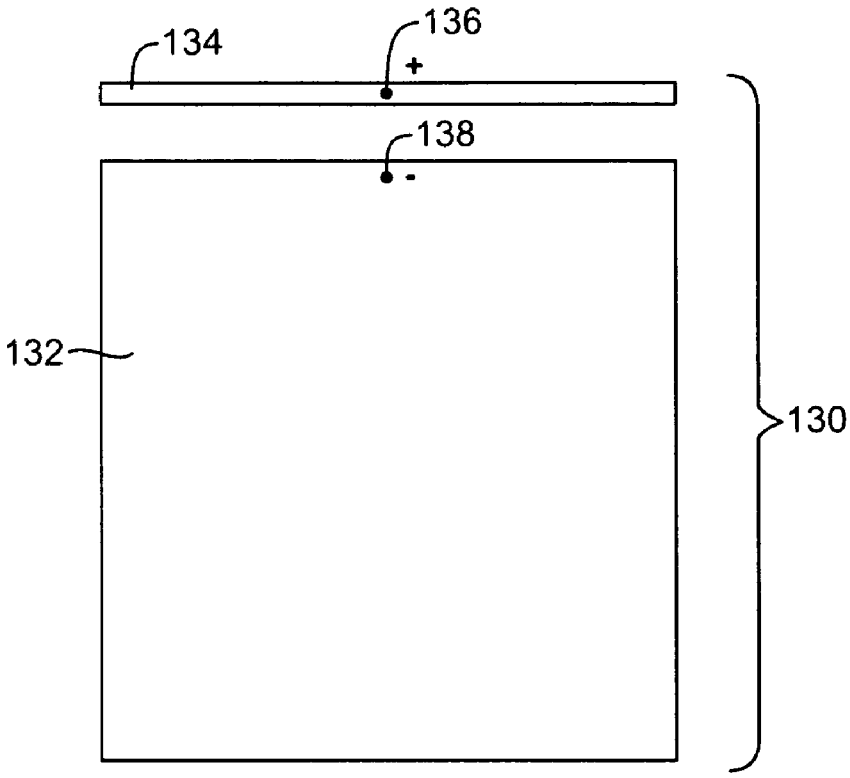
FIG. 14 is a diagram of an illustrative antenna with a center-fed resonating element in accordance with an embodiment of the present invention.

Antenna 130 of FIG. 14 can have ground 132 and resonating element 134. Signals can be provided to antenna 130 using feed terminal 136 and ground terminal 138. Because feed terminal 136 can be connected to the center of resonating element 134, antennas such as antenna 130 are sometimes referred to as center-fed antennas. Elements such as element 134 may sometimes be referred to as self-resonant antenna elements.

Figure 15:
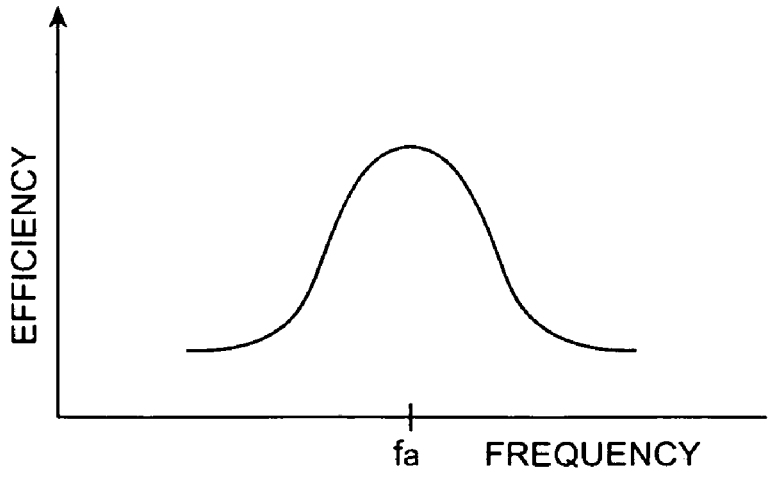
FIG. 15 is a graph of an illustrative efficiency versus frequency characteristic for an antenna of the type shown in FIG. 14 in accordance with an embodiment of the present invention.

Center-fed antennas of the type shown in FIG. 14 exhibit efficiency versus frequency characteristics of the type shown in FIG. 15. As shown in FIG. 15, antenna 130 operates satisfactorily in a single frequency range centered about frequency $f_a$. Frequency $f_a$ is related to the length of self-resonant element 134 (i.e., the length of element 134 is about a quarter of a wavelength at frequency $f_a$).

As shown in FIG. 4, the resonating element of antenna 62 of the present invention has multiple arms 70 and 72 that operate in accordance with the principles discussed in connection with the operation of antenna 116 of FIG. 13 and self-resonant element 74 that operates in accordance with the principles discussed in connection with the operation of antenna 130 of FIG. 14. However, unlike antenna 116 of FIG. 13, which has feed terminal 122 connected to arm 128, antenna 62 of the present invention can have a feed terminal that is not directly electrically connected to arms 70 and 72. Rather, antenna 62 can have feed terminal 80, which is electrically connected to self-resonant element 74. In the illustrative arrangement of FIG. 4, self-resonant element 74 may not be electrically shorted to arms 70 and 72 and ground 66 (i.e., there is an open circuit between element 74 and arms 70 and 72 and ground 66 in the FIG. 4 configuration).

Self-resonant element 74 can serve as an antenna (as described in connection with antenna 130 of FIG. 14) and be near-field coupled to arms 72 and 70 (or at least to arm 72). Through this near-field coupling arrangement, signals at terminal 80 of self-resonant element 74 can be passed to (or from) the rest of resonating element 68, so that the behavior of the rest of resonating element 68 contributes to the performance of antenna 68.

Figure 16:
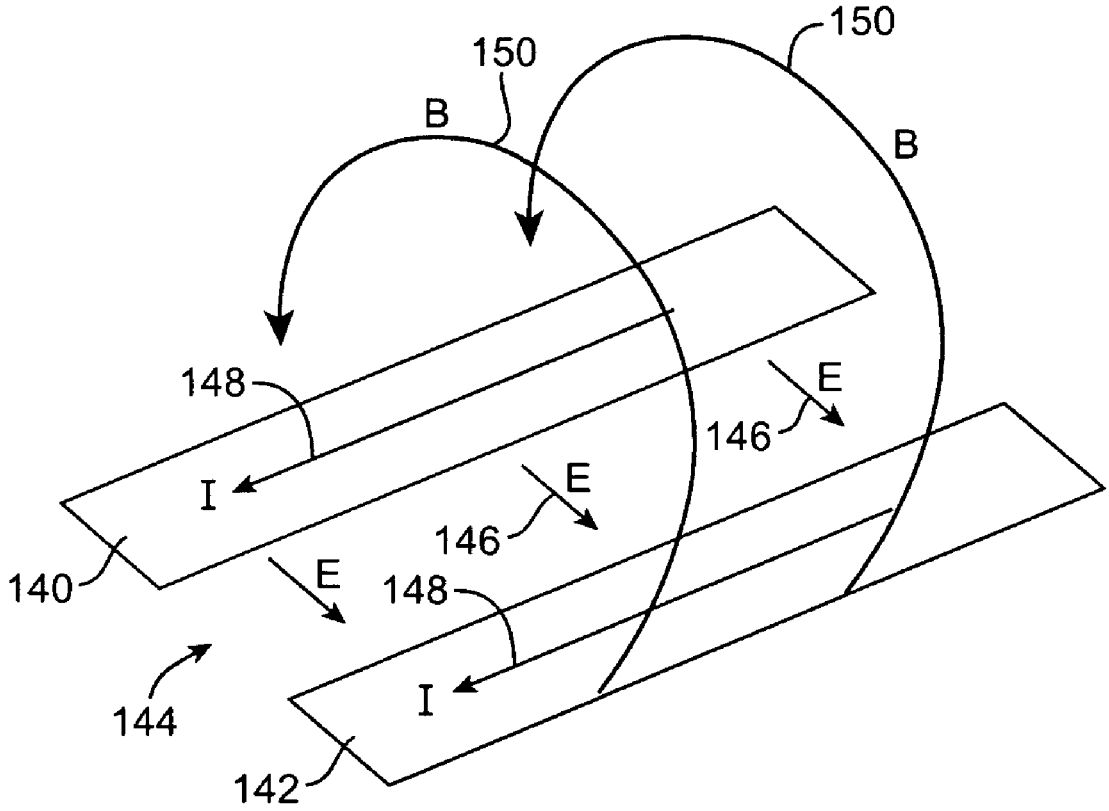
FIG. 16 is a diagram illustrating how two conductive elements can be near-field coupled.

The electromagnetic interactions that underlie the principle of near-field coupling are illustrated in FIG. 16. In FIG. 16, conductors 140 and 142 are electromagnetically coupled through near field interactions. Conductors 140 and 142 are not electrically connected to each other, because gap 144 separates conductors 140 and 142. As a result, direct current (DC) signals cannot pass from conductor 140 to conductor 142. Through near-field coupling, however, signals on one of conductors 140 and 142 can be passed to the other.

Near field coupling can involve both electric-field coupling and magnetic-field coupling. As shown by arrows 146, when the voltages on conductors 140 and 142 differ, an electric field E is established across gap 144. As a result, when a voltage signal is generated on one conductor, a corresponding electric field spans gap 144 and induces currents in the other conductor. As shown by arrows 150, when a current I flows in direction 148 in one of the conductors 140 and 142, a magnetic field B is created. The magnetic field induces a similar current I in the other conductor. Signals can therefore be transmitted across gap 144 by near-field coupling, even though conductors 140 and 142 are not electrically connected by a DC path.

A near-field coupling mechanism is used in antenna 62 to couple signals into and out of resonating element 68. Signals are applied to (and, in receive mode, are received from) feed terminal 80 and ground terminal 78 (FIG. 4). Feed terminal 80 is connected to self-resonant element 74. Self-resonant element 74 forms an antenna that resonates at a range of frequencies centered around a single peak, as described in connection with FIGS. 14 and 15. Through near-field coupling, the rest of resonating element 68 is coupled to self-resonant element 74 and positive terminal 80, so that arms 70, 72, and 74 each provide contributions to the overall performance of resonating element 68. In particular, arm 72 can be near-field coupled to self-resonant element 74 by the relatively close proximity of element 74 and element 72 (e.g., a gap of about 1-3 mm between these elements). Although arm 70 can be located farther from element 74, arm 70 may also be somewhat near-field coupled to element 74 and can be, in any event, electrically coupled to arm 72 by conductive portion 71. The near-field coupling arrangement of antenna 62 may be referred to as a near-field-coupled feed arrangement, because the antenna's feed terminal is connected to near-field coupling element 74.

The different resonating element portions of antenna 62 work together to provide broad frequency coverage. With one suitable arrangement antenna 62 can cover six communications bands of interest. The contributions of the different parts of antenna 62 to its overall frequency characteristic can be understood with reference to FIGS. 15, 17, 18, and 19.

Figure 17:
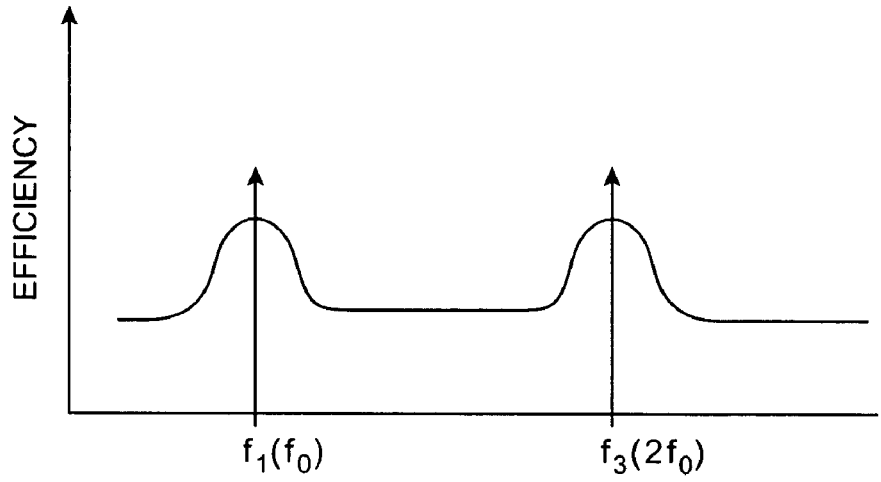
FIG. 17 is a graph of an illustrative efficiency versus frequency characteristic for an asymmetric dipole antenna of the type shown in FIG. 11 in accordance with an embodiment of the present invention.

As described in connection with antenna 120 of FIG. 11, resonating element arm 72 and ground 66 of antenna 62 exhibit a response of the type shown in FIG. 17. As shown in FIG. 17, the antenna resonates (and therefore may be used for transmission and reception of radio-frequency signals) at fundamental frequency $f_0$ and at harmonic frequency $2f_0$. The contribution of arm 72 therefore allows antenna 62 to cover frequency bands at $f_1=f_0$ and at $f_3=2f_0$, as shown in FIG. 17.

Figure 18:
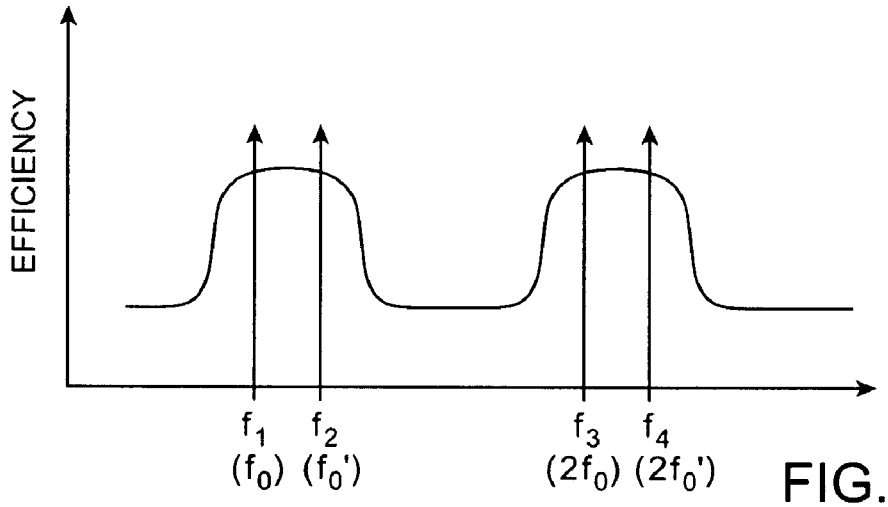
FIG. 18 is a graph of an illustrative efficiency versus frequency characteristic for an asymmetric dipole antenna of the types shown in FIGS. 12 and 13 in accordance with an embodiment of the present invention.

Arm 70 of antenna 62 can contribute resonance peaks at slightly higher frequency $f_0'$ and at slightly higher frequency $2f_0'$, corresponding to respective communications bands frequencies $f_2$ and $f_4$. The combined contributions of arms 70 and 72 are shown in the performance characteristic of FIG. 18. As shown in FIG. 18, when contributions from both arm 72 and arm 70 are taken into consideration, the antenna's response can include a first operative frequency range that covers communications bands centered around $f_1$ and $f_2$ and a second operative frequency range that covers communications bands centered around $f_3$ and $f_4$.

Self-resonant antenna element 74 can make another contribution to the performance of antenna 62. As shown in FIG. 15 and as described in connection with FIG. 14, the contribution of element 74 is characterized by a single peak centered about a frequency $f_a$. The size of self-resonant element 74 may be selected (as an example) so that the frequency $f_a$ lies between two further communications bands of interest $f_5$ and $f_6$. By including element 74 in resonating element 68 and antenna 62, the overall performance of antenna 62 can be boosted in the vicinity of frequency $f_a$.

Figure 19:
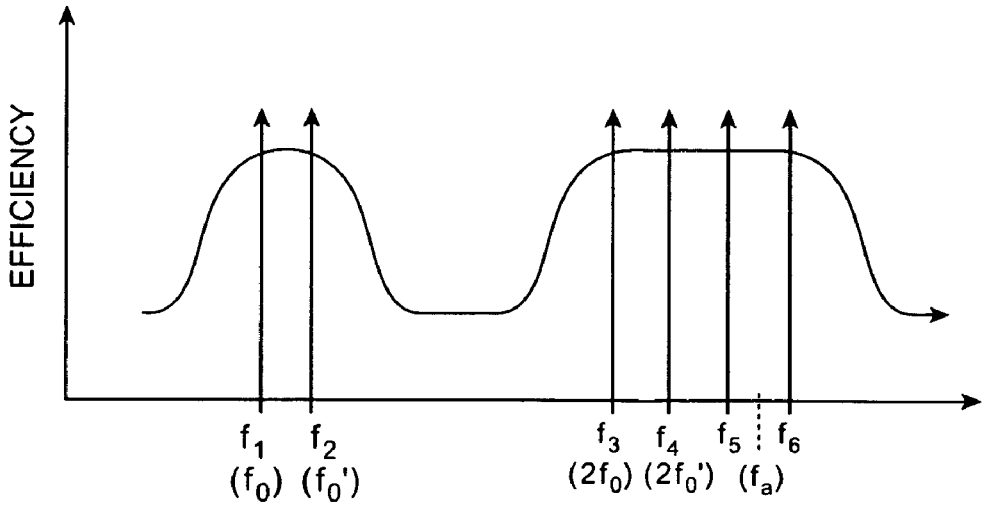
FIG. 19 is a graph of an illustrative efficiency versus frequency characteristic for a broadband antenna with a coupled feed in accordance with an embodiment of the present invention.

An illustrative overall performance characteristic for antenna 62 is shown in FIG. 19. As shown in FIG. 19, antenna 62 operates in a first (lower) frequency range that covers bands $f_1$ and $f_2$ and in a second (higher) frequency range that covers communications bands $f_3$, $f_4$, $f_5$, and $f_6$. The contribution from element 74 boosts the frequency response of antenna 62 in the second frequency range around the frequency $f_a$ and ensures that the second frequency range covers the communications bands centered at $f_5$ and $f_6$. With one suitable arrangement, antenna 62 may be used to cover communications frequency bands, such as the cellular telephone bands at 850 MHz, 900 MHz, 1800 MHz, and 1900 MHz, data service bands, such as the 3G data communications band at 2170 MHz band (commonly referred to as UMTS or Universal Mobile Telecommunications System), the WiFi® (IEEE 802.11) band at 2.4 GHz, and the Bluetooth® band at 2.4 GHz. With this type of arrangement, $f_1$=850 MHz, $f_2$=900 MHz, $f_3$=1800 MHz, $f_4$=1900 MHz, $f_5$=2170 MHz, and $f_6$=2.4 GHz, for example.

Figure 20:
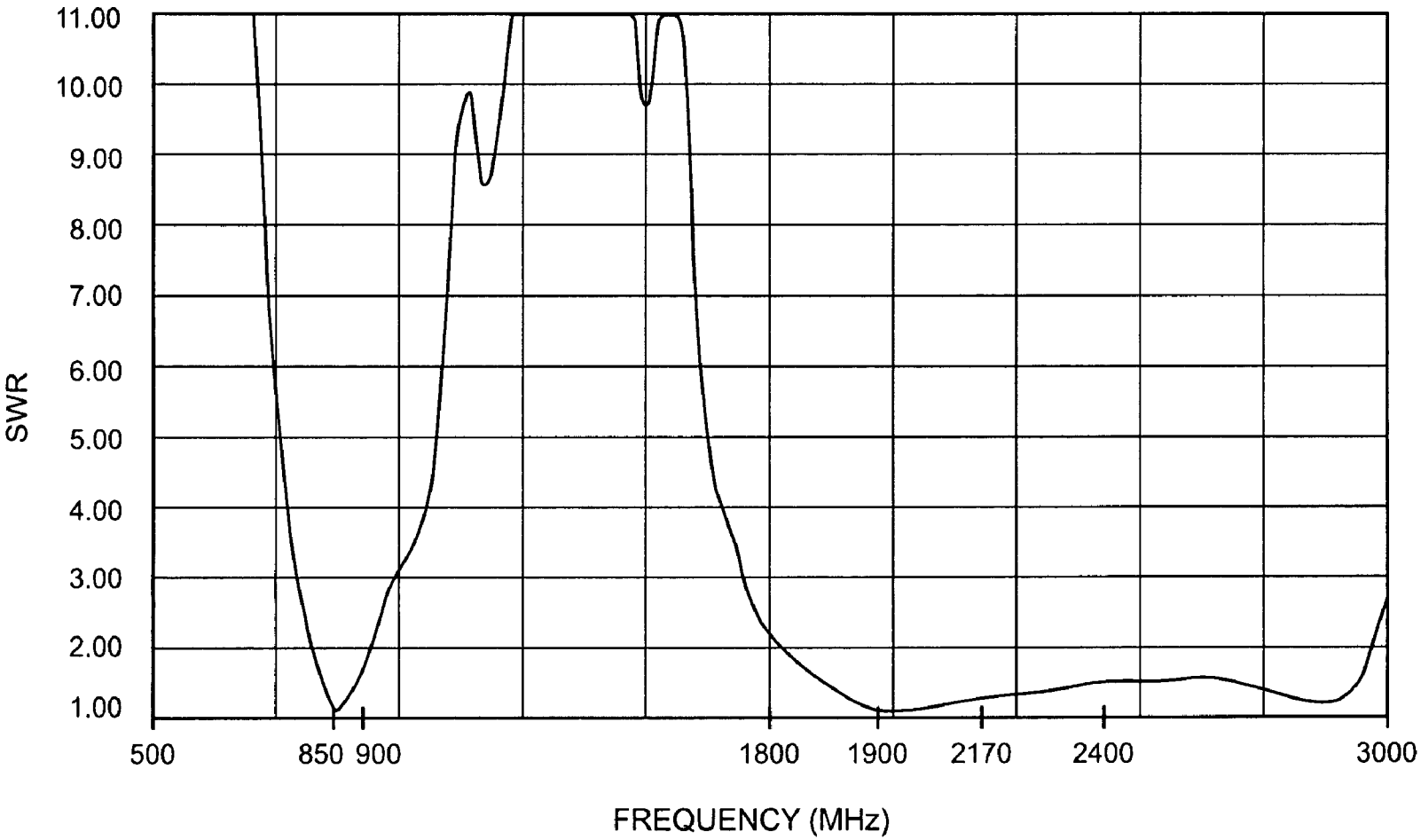
FIG. 20 is a graph of measured standing-wave-ratio values versus frequency for a broadband antenna of the type shown in FIG. 4 in accordance with an embodiment of the present invention.

One way to characterize the performance of broadband antenna 62 involves the use of a standing-wave-ratio plot. The standing-wave ratio (SWR) of an antenna is a measure of the antenna's ability to efficiently transmit radio waves. Standing wave ratios R of less than about three are generally acceptable. A graph plotting the measured standing-wave-ratio versus frequency characteristic for an illustrative broadband antenna of the type shown in FIG. 4 is shown in FIG. 20. In the example of FIG. 20, the SWR value for the antenna is three or less in the vicinity of all bands of interest such as the 850 MHz, 900 MHz, 1800 MHz, and 1900 MHz cellular telephone bands, and the 2170 MHz and 2400 MHz data bands (in this example).

Figure 21:
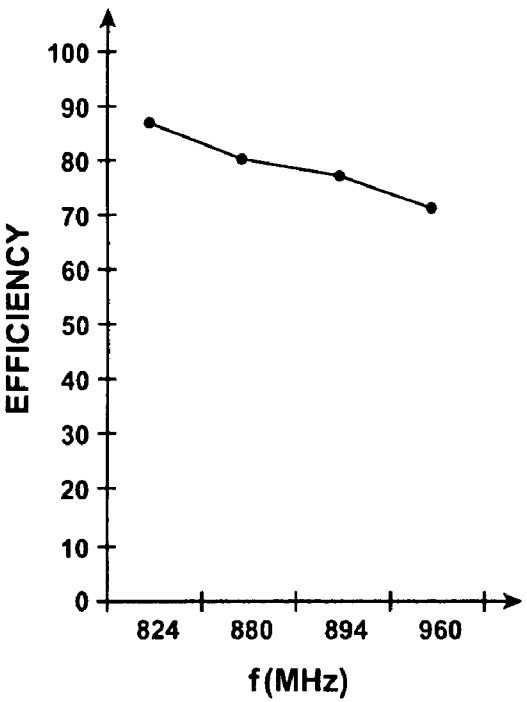
FIGS. 21, 22, and 23 are graphs of measured antenna efficiency versus frequency for a broadband antenna of the type shown in FIG. 4 in accordance with an embodiment of the present invention.
Figure 22:
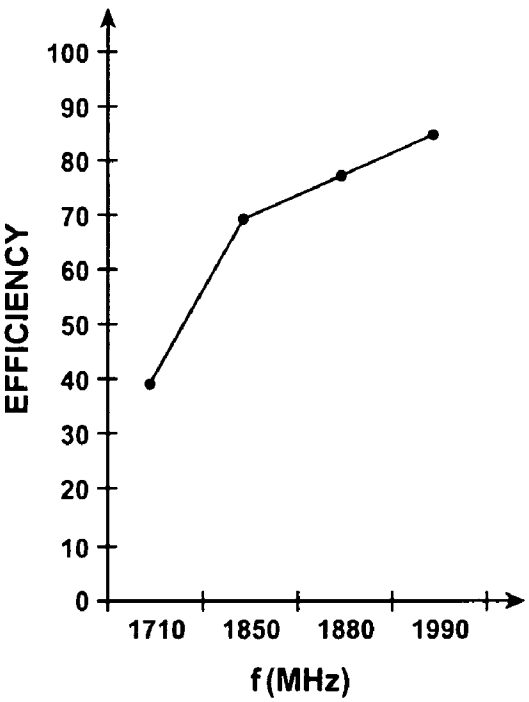
Figure 23:
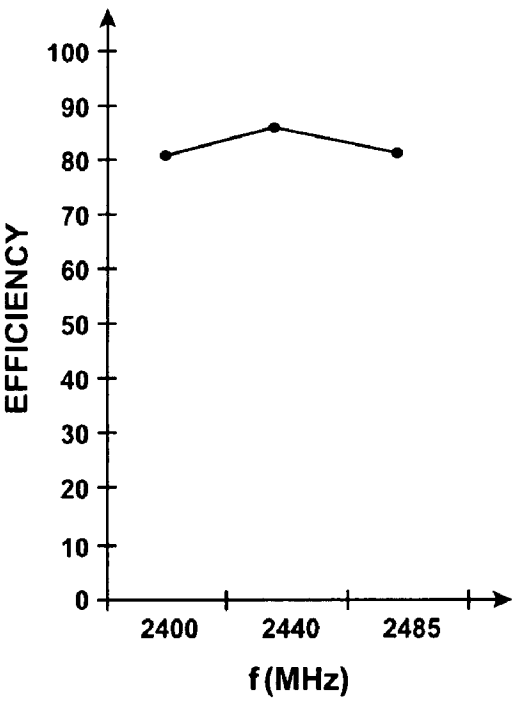

The performance of broadband antenna 62 has also been characterized by measuring its efficiency in several frequency ranges of interest. The graphs of FIGS. 21, 22, and 23 demonstrate how broadband antenna 62 has been measured to have good efficiency characteristics from 824-960 MHz (FIG. 21), 1710-1990 MHz (FIG. 22), and 2400-2485 MHz (FIG. 23). Based on the SWR results of FIG. 19, antenna 62 is also expected to have good efficiency characteristics at 2170 MHz.

Figure 24:
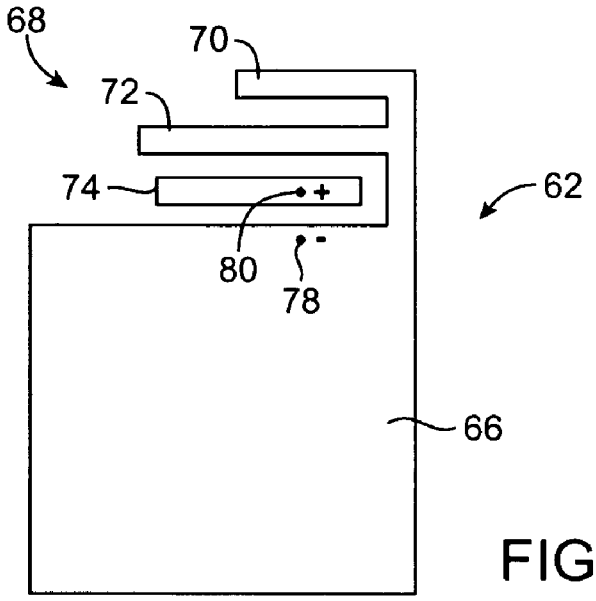
FIG. 24 is a diagram of an illustrative broadband antenna with a coupled feed in accordance with an embodiment of the present invention.

As shown in FIG. 24, antenna 62 can be formed in a configuration in which resonating element 68 is not surrounded with ground 66. If desired, arms such as arms 70 and 72 and self-resonant element 74 may have different sizes and shapes. The arrangement of FIG. 24 is merely illustrative.

Figure 25:
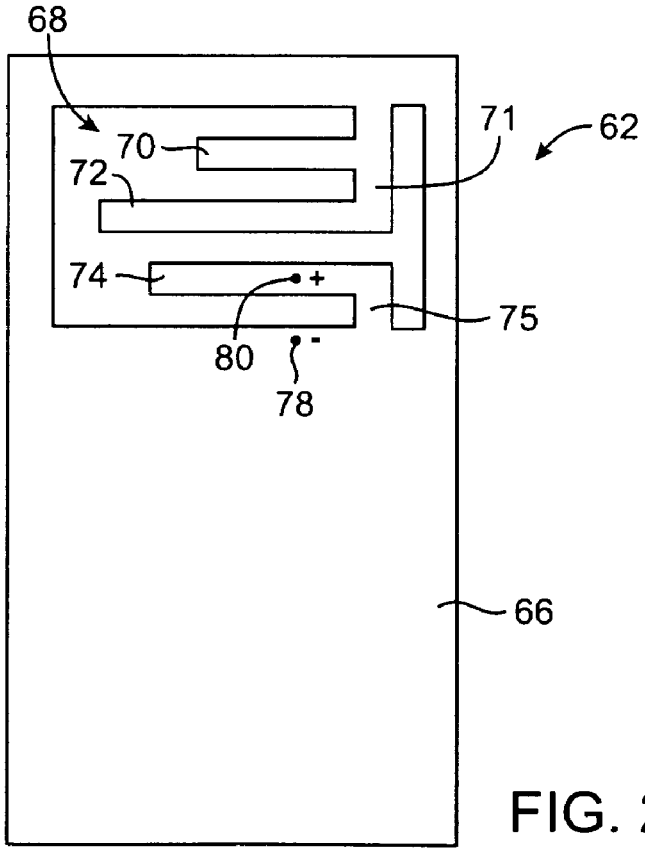
FIG. 25 is a diagram of another illustrative broadband antenna with a coupled feed in accordance with an embodiment of the present invention.

As shown in FIG. 25, antenna 62 may be formed in a configuration that uses a parallel-fed self-resonant element 74, where strip-shaped shorting conductive portion 75 is used to electrically connect element 74 to ground 66. In this configuration, element 74 is electrically connected to ground 66 through conductor 75, but due to the near-field coupling between element 74 and arm 72 and due to the connection of arms 70 and 72 through conductor 71, arms 70 and 72 and element 74 serve as the antenna's resonating element.

Figure 26:
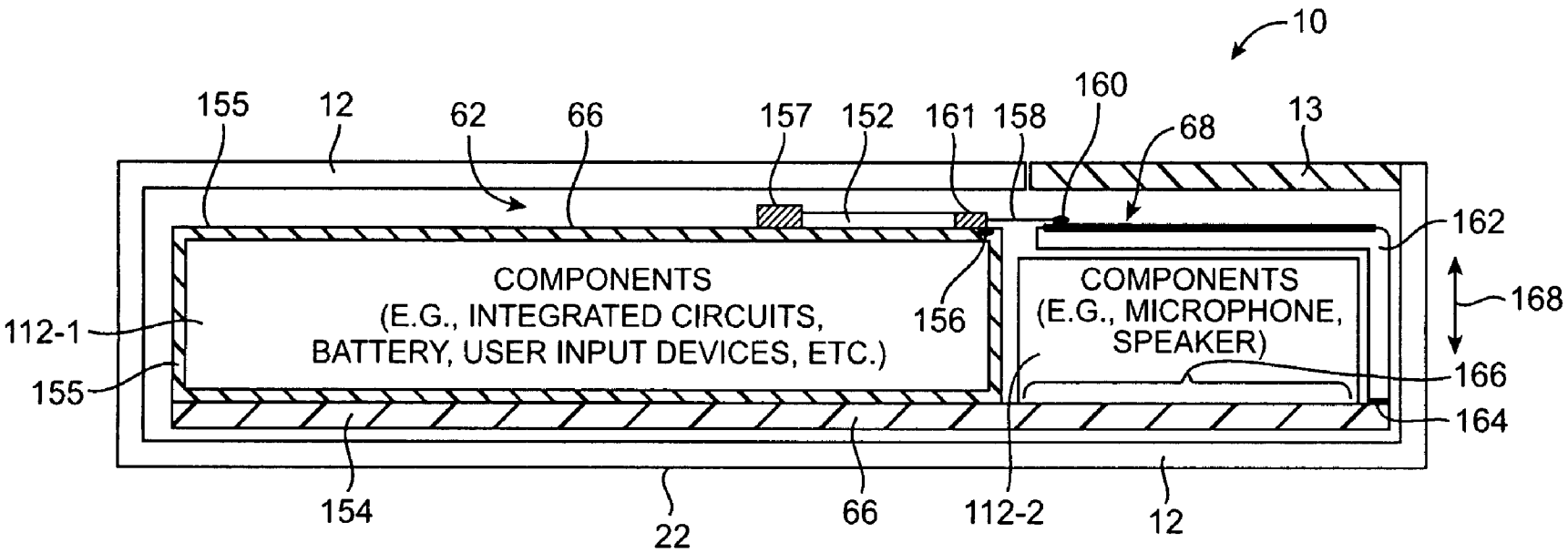
FIG. 26 is a cross-sectional side view of an illustrative handheld electronic device having an illustrative three-dimensional broadband antenna with a coupled feed in accordance with an embodiment of the present invention.

If desired, antenna 62 may be formed using a three-dimensional arrangement. A cross-sectional view of antenna 62 in a three-dimensional configuration in handheld device 10 is shown in FIG. 26. As shown in FIG. 26, handheld electronic device 10 has a case 12. Case 12 may be used to house electrical components 112-1 and 112-2 such as speakers, cameras, microphones, batteries, integrated circuits, keypads and other user control interfaces, connectors such as input-output jacks and power jacks, status indicators such as light-emitting diodes, displays such as liquid crystal displays, etc.

Case 12 may, as an example, be formed from metal or other conductive materials. Case 12 may also have a non-conductive portion such as cap 13. Cap 13 may be formed from plastic or other suitable dielectric and may be located adjacent to resonating element 68 of antenna 62. Ground 66 of antenna 62 may be formed from metal or other suitable conductors formed on one or both sides of circuit board 154 or other suitable mounting structures. Ground 66 may also be formed by metal or other suitable conductors that are used to encase the electrical components in device 10. For example, some or all of components 112-1 may be encased in a conductive shielding layer 155 (e.g., copper RF shielding). Ground 66 may be formed at least partly using this conductive shielding as shown in FIG. 26. The conductive shielding may be electrically connected to conductive case 12 (e.g., using screws, brackets, and other connecting structures in device 10), which further extends ground 66.

Connector 157 (e.g., a connector such as a mini UFL connector) or other suitable attachment structures may be used to connect coaxial cable 152 or other suitable radio-frequency signal path structures to components 66. In the example of FIG. 26, connector 154 is shown schematically as being connected to components 112-1. This is merely illustrative. Connector 154 may, for example, be connected to circuit board 154, may be part of a transceiver module that makes up one of components 112-1, or may be connected to electrical components in device 10 using any other suitable technique.

Coaxial cable center conductor 158 may be electrically connected to resonating element 68 using solder 160 (as an example). Outer conductive braid 161 of coaxial cable 152 may be soldered to ground 66 (e.g., metal shielding surrounding components 112-1) using solder 156. Solder 160 may be used to connect conductor 158 to self-resonant element 74 at feed terminal 80 of FIG. 4. Solder 156 may be used to connect outer conductive portion 161 of cable 152 to ground 66 at ground terminal 78 of FIG. 4.

Resonating element 68 may be formed on a flexible substrate (e.g., a flexible polyimide-backed circuit substrate sometimes referred to as a flex circuit). A plastic support or other suitable structure 162 may be used to support the flex circuit from either side of the flex circuit. Ground extension portions such as portions 84, 86, and 88 of FIG. 4 may be electrically connected to ground 66 on circuit board 154 using solder, spring-loaded pins, or other suitable electrical connection structures 164.

To ensure that antenna 62 works properly, it may be desirable to locate components that contain large amounts of conductor in components region 112-1 and to locate other components in components region 112-2. For example, integrated circuits such as a transceiver integrated circuit, microprocessor, and memory, may be encased in conductive shielding. Due to the presence of the conductive shielding, which is shorted to ground 66, these components may be best located in components region 112-1, adjacent to metal case 12. Other components may be located in region 112-2. With one suitable arrangement, certain components (e.g., a microphone and speaker) are located in region 112-2. If desired, there may be few or no components in components region 112-2, so that resonating element 68 is surrounded by air.

Circuit board 154 and portions of ground element 66 that are formed from metal or other conductive materials located on one or both sides of circuit board 154 may be mounted to planar front face 22 of housing 12 and device 10 (as an example). To provide sufficient clearance between resonating element 68 and portions of ground 66 that are associated with components 112-2 and lie on circuit board 154 in region 166, case 12 and support 162 may be constructed to ensure that there is at least 5-10 mm of vertical spacing between circuit board 154 and resonating element 68 along dimension 168, which is perpendicular to the plane containing circuit board 154 and planar housing face 22.

The foregoing is merely illustrative of the principles of this invention and various modifications can be made by those skilled in the art without departing from the scope and spirit of the invention.

What is claimed is:

1. A handheld electronic device antenna, comprising:

a ground element;

a resonating element comprising a first arm having a first length, a second arm having a second length that is different than the first length, and a self-resonant element that is near-field coupled to the second arm, wherein the self-resonant element is not electrically shorted to the ground element;

an antenna ground terminal connected to the ground element; and an antenna feed terminal connected to the self-resonant element.

2. The handheld electronic device antenna defined in claim 1 further comprising:

a flex circuit mounting structure on which the resonating element is formed.

3. The handheld electronic device antenna defined in claim 1 further comprising:

a planar mounting structure on which the ground element and the resonating element are formed.

4. The handheld electronic device antenna defined in claim 1 further comprising:

a mounting structure on which the resonating element and at least part of the ground element are formed;

ground extension portions on the mounting structure that surround the resonating element on at least three sides.

5. The handheld electronic device antenna defined in claim 1 further comprising:

a mounting structure on which the resonating element and at least part of the ground element are formed;

ground extension portions on the mounting structure that surround the resonating element on at least three sides; and a conductive handheld electronic device housing in which the mounting structure is mounted.

6. A portable electronic device comprising:

a housing;

at least one integrated circuit mounted in the housing that generates data for wireless transmission, and that processes data that is wirelessly received by the electronic device; and wireless communications circuitry mounted in the housing that communicates with the integrated circuit, wherein the wireless communications circuitry comprises an antenna comprising a ground element formed at least partly from conductive shielding that surrounds the integrated circuit and a resonating element, wherein the resonating element comprises a first arm having a first length, a second arm having a second length that is different than the first length, and a self-resonant element that is near-field coupled to the second arm, and wherein the ground element surrounds the resonating element on at least three sides.

7. The portable electronic device defined in claim 6 wherein a ground terminal is connected to the ground element, wherein a feed terminal is connected to the self-resonant element, wherein the self-resonant element comprises a conductive material that is not electrically shorted to the ground element, and wherein the portable electronic device is a wearable portable electronic device.

8. The portable electronic device defined in claim 6 wherein a ground terminal is connected to the ground element, wherein a feed terminal is connected to the self-resonant element, and wherein the antenna comprises a shorting conductive portion that electrically connects the self-resonant element to the ground so that the self-resonant element is parallel fed.

9. The portable electronic device defined in claim 6 wherein the housing has a planar face, wherein a portion of the ground element is mounted to the planar face, and wherein the portable electronic device is a miniature electronic device.

10. The portable electronic device defined in claim 6 wherein the housing has a planar face, wherein a portion of the ground element is mounted to the planar face, and wherein the resonating element is separated from the portion of the ground element that is mounted to the planar face by at least 5 mm in a dimension that is perpendicular to the planar face, the portable electronic device further comprising a microphone located between the planar rear face and the resonating element, wherein the portable electronic device comprises at least a media player.

11. A handheld electronic device comprising:

a housing;

a broadband antenna comprising a ground element and a resonating element, wherein at least a portion of the ground element and the resonating element lie in a common plane, the resonating element comprising a first arm having a first length, a second arm having a second length that is different than the first length, and a self-resonant element that is near-field coupled to the second arm, wherein the self-resonant element is not electrically shorted to the ground element; and at least one integrated circuit that is located within the housing adjacent to the portion of the ground element that lies in the common plane, wherein an antenna ground terminal is connected to the ground element and wherein an antenna feed terminal is connected to the self-resonant element.

12. The handheld electronic device defined in claim 11 wherein the housing comprises:

a conductive portion;

a plastic cap adjacent to the resonating element.

13. The handheld electronic device defined in claim 11 further comprising a flexible circuit substrate on which the resonating element and at least a portion of the ground element are formed.

14. The handheld electronic device defined in claim 11 further comprising a coaxial cable having a center conductor that is connected to the self-resonant element and having an outer conductor that is connected to the ground element.

15. The handheld electronic device defined in claim 11 wherein the first and second arms comprise metal, wherein the first length is shorter than the second length, and wherein the self-resonant element is located adjacent to the second arm and is separated from the second arm by a gap of at least 1 mm.

16. A handheld electronic device comprising:

a housing;

an integrated circuit;

an antenna comprising a ground element, and a resonating element, an antenna ground terminal, and an antenna feed terminal, wherein the resonating element comprises an F-shaped element and a self-resonant element, wherein the F-shaped element and the self-resonant element are near-field coupled, wherein the self-resonant element is rectangular and is separated from the F-shaped element by a gap, wherein the antenna ground terminal is connected to the ground element, wherein the antenna feed terminal is connected to the self-resonant element, and wherein the self-resonant element comprises a conductive material that is not electrically shorted to the ground element.

17. The handheld electronic device defined in claim 16 further comprising a radio-frequency path that connects the integrated circuit to the antenna, wherein the radio-frequency path comprises a first conductor connected to the self-resonant element and a second conductor connected to the ground element.

18. The handheld electronic device defined in claim 16 further comprising conductive radio-frequency shielding surrounding the integrated circuit, wherein the ground element is formed at least partly from the radio-frequency shielding.

19. The handheld electronic device defined in claim 16 wherein the conductive material comprises metal.

20. A broadband antenna in a handheld electronic device that has a planar front surface, comprising:

a ground element comprising a planar portion that is parallel to the planar front surface; and a resonating element comprising first and second arms of unequal length and comprising a rectangular element that is not electrically shorted to the ground element, that is not electrically shorted to the first and second arms, and that is near-field coupled to the second arm of the resonating element, wherein the ground element comprises three rectangular ground extension portions that together surround the resonating element on three sides.

21. The broadband antenna defined in claim 20 wherein the three rectangular ground extension portions and the planar portion of the ground element surround the resonating element on four sides.

22. The broadband antenna defined in claim 20 wherein the resonating element comprises metal and wherein the integrated circuit generates data that is transmitted through the antenna in a first frequency range that includes an 850 MHz communications band and a 900 MHz communications band and a second frequency range that includes a 1800 MHz communications band, a 1900 MHz communications band, a 2170 MHz communications band, and a 2400 MHz communications band.

23. The broadband antenna defined in claim 20 further comprising an antenna feed terminal that is connected to the rectangular element, wherein the integrated circuit generates data that is transmitted through the antenna in first and second non-overlapping frequency ranges.

24. An antenna in a handheld electronic device having a housing, comprising:

a ground element comprising at least one planar portion; and a resonating element comprising a first arm having a first length, a second arm having a second length that is longer than the first length, and a self-resonant element that is near-field coupled to the second arm, wherein the second arm and the self-resonant element are substantially rectangular and are separated by a gap, wherein an antenna feed terminal is connected to the self-resonant element, wherein an antenna ground terminal is connected to the planar portion of the ground element, wherein the ground element comprises ground extension portions, and wherein the planar portion and the ground extension portions surround the first arm, the second arm, and the self-resonant element.

25. The antenna defined in claim 24 wherein the first arm, the second arm, and the self-resonant element are located in a common plane on a mounting structure formed from dielectric.

26. The antenna defined in claim 24 further comprising a mounting structure comprising printed circuit board materials on which at least part of the ground element is formed.

27. The antenna defined in claim 24 wherein the resonating element comprises metal and wherein the first arm, the second arm, and the self-resonant element each have a length and a height, wherein the lengths are each less than 10 cm and wherein the heights are between 3 mm and 10 mm.

* * * * *

UNITED STATES PATENT AND TRADEMARK OFFICE

CERTIFICATE OF CORRECTION

PATENT NO. : 7,688,267 B2
APPLICATION NO. : 11/593752
DATED : March 30, 2010
INVENTOR(S) : Robert J. Hill It is certified that error appears in the above-identified patent and that said Letters Patent is hereby corrected as shown below:

In column 8, line 13, delete “phonolic” and insert -- phenolic --, therefor.

Signed and Sealed this
Twenty-second Day of November, 2011

David J. Kappos

David J. Kappos
*Director of the United States Patent and Trademark Office*